US009752341B2

(12) United States Patent
Wastel

(10) Patent No.: US 9,752,341 B2
(45) Date of Patent: Sep. 5, 2017

(54) VEHICLE PARKING WITH AUTOMATED GUIDED VEHICLES, VERTICALLY RECIPROCATING CONVEYORS AND SAFETY BARRIERS

(71) Applicant: Park Plus, Inc., Oakland, NJ (US)

(72) Inventor: Andreas N. Wastel, Randolph, NJ (US)

(73) Assignee: Space Maker International Inc., Fairview, NJ (US)

( * ) Notice: Subject to any disclaimer, the term of this patent is extended or adjusted under 35 U.S.C. 154(b) by 0 days.

(21) Appl. No.: 15/019,035

(22) Filed: Feb. 9, 2016

(65) Prior Publication Data

US 2017/0226765 A1 Aug. 10, 2017

(51) Int. Cl.

| | |
|---|---|
| ***E04H 6/42*** | (2006.01) |
| ***E04H 6/12*** | (2006.01) |
| ***E04H 6/24*** | (2006.01) |
| ***E04H 17/00*** | (2006.01) |
| ***E05F 15/603*** | (2015.01) |

(Continued)

(52) U.S. Cl.

CPC ..... *E04H 6/424* (2013.01); *E01F 13/044* (2013.01); *E01F 13/046* (2013.01); *E01F 13/048* (2013.01); *E04H 6/12* (2013.01); *E04H 6/24* (2013.01); *E04H 6/426* (2013.01); *E04H 17/00* (2013.01); *E05F 15/603* (2015.01); *E05F 15/665* (2015.01); *E05F 15/70* (2015.01); *E06B 9/06* (2013.01); *E06B 11/025* (2013.01); *E06B 2009/002* (2013.01)

(58) Field of Classification Search

CPC ..... E01F 13/00; E01F 13/04; E01F 13/042; E01F 13/044; E01F 13/048; E01F 13/024; E01F 13/046; E06B 9/06; E06B 11/025; E04G 21/3223; B65G 69/2888; E04H 6/424; E04H 6/426

USPC ..... 49/49, 103; 256/73; 160/202, 205, 222, 160/211, 216, 223

See application file for complete search history.

(56) References Cited

U.S. PATENT DOCUMENTS 113,001 A * 3/1871 Adams ..... E04H 17/00 49/10
1,492,420 A * 4/1924 Burke ..... E06B 3/925 160/193

(Continued)

FOREIGN PATENT DOCUMENTS

JP WO 2011024612 A1 * 3/2011 ..... B61B 1/02

*Primary Examiner* — Katherine Mitchell
*Assistant Examiner* — Marcus Menezes
(74) *Attorney, Agent, or Firm* — Gerald E. Hespos; Michael J. Porco; Matthew T. Hespos

(57) ABSTRACT

A safety barrier assembly is provided for a parking garage is positioned in proximity to an opening for a VRC and includes a horizontal AGV safety beam and upper and lower pedestrian barriers having horizontal railings and vertical legs. The vertical legs are slidable within openings at opposite ends of the AGV safety beam. The vertical legs of the upper pedestrian barrier are longer than those of the lower pedestrian barrier. The AGV safety beam can be moved vertically between a lower position where the AGV safety beam is substantially adjacent a floor of the parking garage and an upper position where the AGV safety beam is elevated from the floor. The horizontal railings of the pedestrian barriers are parallel to and spaced above the AGV safety beam in the lower position. However, the horizontal railings abut the AGV safety beam in the upper position.

5 Claims, 19 Drawing Sheets

(51) Int. Cl.

| | |
|---|---|
| ***E05F 15/70*** | (2015.01) |
| ***E05F 15/665*** | (2015.01) |
| ***E01F 13/04*** | (2006.01) |
| ***E06B 9/06*** | (2006.01) |
| ***E06B 11/02*** | (2006.01) |
| *E06B 9/00* | (2006.01) |

(56) References Cited

U.S. PATENT DOCUMENTS

| | | | | | |
|---|---|---|---|---|---|
| 3,304,994 | A * | 2/1967 | Kozak | E06B 3/925 | 160/193 |
| 3,341,971 | A * | 9/1967 | Hartman, Jr. | E06B 5/16 | 160/1 |
| 5,118,056 | A * | 6/1992 | Jeanise | E01F 13/048 | 246/111 |
| 5,271,183 | A * | 12/1993 | Hahn | E01F 13/048 | 49/103 |
| 5,829,912 | A * | 11/1998 | Marcotullio | E01F 13/12 | 404/6 |
| 6,860,311 | B1 * | 3/2005 | Minor | E05D 15/18 | 160/193 |
| 2007/0085067 | A1 * | 4/2007 | Lewis | E01F 13/065 | 256/73 |
| 2013/0183124 | A1 * | 7/2013 | Wastel | E04H 6/22 | 414/261 |
| 2015/0139762 | A1 * | 5/2015 | Stephens | E04H 6/22 | 414/261 |

* cited by examiner

VEHICLE PARKING WITH AUTOMATED GUIDED VEHICLES, VERTICALLY RECIPROCATING CONVEYORS AND SAFETY BARRIERS

BACKGROUND OF THE INVENTION

1. Field of the Invention

The invention relates to an automated parking facility with automated guided vehicles for moving passenger vehicles on a floor of a parking facility and vertically reciprocating conveyors for moving the automated guided vehicles and/or the passenger vehicles between floors of the parking facility.

2. Description of the Related Art

Municpalities throughout the world continue to grow in size and population density, and the number of vehicles in a municipality varies directly with the population size and density. Most municipalities have zoning ordinances that control the number of parking spaces required for all new construction so that real estate developers provide sufficient parking for residents, tenants employees and customers of new real estate developments. The required number of parking spaces generally is a function of the number of residential units and the square footage of office and retail space.

Suburban real estate developers generally can provide a sufficient number of parking spaces with grade level lots in proximity to the real estate development. Parking garages generally are not required for suburban real estate development and those parking garages that may be required generally do not present complicated design difficulties.

Real estate developments in urban areas are much more likely to require parking garages, and parking garages in urban areas are much more likely to present design problems. For example, profitability of an urban real estate development is a function of the ratio between the size of the lot and the amount of development that can be placed on that lot. Tall buildings are more likely to be profitable, but also require more parking. A parking garage can be built adjacent to the residential, retail or office building. However, the parking garage adjacent to the new construction limits the amount of the site that can be used for developing the residential, retail or office space. As a result, parking garages often are built below the building that will be served by the parking garage. Above grade parking garages are less costly than below grade parking garages. However, above grade parking garages often are aesthetically unattractive and detract from the architectural appearance of the new building. Below grade parking garages are aesthetically more attractive, but can be cost prohibitive, particularly in coastal areas where flooding is a concern.

Municipal ordinances also are likely to control the size of each parking space and the width of parking aisles to ensure that parkers have sufficient room to maneuver into and out of parking spaces and throughout the parking garage.

Real estate developers can request zoning variances in situations where the zoning ordinance is too burdensome for a particular site. However, the real estate developer must demonstrate that an acceptable alternate can be provided to the specific parking requirements established by the zoning ordinance.

Devices have been available for decades to permit two or more cars to be arranged vertically in a single parking space. The typical device of this type has a platform with sufficient structural rigidity to support a vehicle thereon. Piston/cylinder arrangements or pulleys with chains or cables are provided to raise or lower the parking platform with or without the vehicle thereon. The typical parking platform has a sloped entrance ramp that the vehicle negotiates to enter onto the parking platform. An employee of the parking facility then actuates the lift mechanism to elevate the parking platform with the vehicle thereon. Another vehicle then can be driven into the space below the parking platform. Many such parking devices have more than one parking platform and hence permit more than two vehicles to be parked in a vertical array. Examples of parking devices of this type are shown in U.S. Pat. No. 4,772,172 and in U.S. Pat. No. 7,597,521.

Parking lots that rely upon vehicle lift devices require considerable room for the vehicle owner and/or the parking lot operator to maneuver vehicles from the entrance of the facility to the appropriate vehicle lift device. Most parking lots and parking garages that rely upon this technology do not have automated systems for locating the vehicle or for organizing the stacked arrangement of vehicles. As a result, a significant amount of maneuvering is required to park or retrieve a vehicle. These parking systems tend to be very labor intensive and create the potential for minor accidents as the vehicles are being maneuvered by employees of the parking lot.

Recent work by the assignee of the subject invention has related to the use of automated guided vehicles (AGVs) to move vehicles throughout a parking facility. AGVs are highly maneuverable and precisely controllable. Therefore, an AGV is well-suited for moving vehicles in the tightly confined spaces of a parking facility. AGVs typically would be used in combination with parking trays. More particularly, each parking tray may have a generally planar supporting platform on which the vehicle can be parked and legs extend down from the supporting platform to keep the supporting platform and the vehicle thereon in a slightly elevated position. The AGV is dimensioned to move between the legs and under the supporting platform. Elevating mechanisms on the AGV then can be activated to lift the tray and the depending legs slightly from the floor of the parking facility. The AGV then will maneuver the parking tray and the vehicle thereon to an appropriate parking space in the facility. The AGV then may leave the parked car and the tray and move to another location in the parking facility for moving another tray and another vehicle either into or out of the parking facility. The combination of AGVs and parking trays typically will be used with vertical reciprocating conveyors (VRCs) to permit vehicles to be moved between floors of a parking garage. Systems of this type avoid the need to have the parker drive to and from the parking space. Rather, the parker merely deposits the car on a tray at and ingress bay and retrieves the car later from a tray that has been moved to an egress bay. Parking systems of this type also reduce the labor costs associated with having workers move cars through a parking facility and into the parking spot and then having workers retrieve the cars from the designated parking spot. The recent work in connection with parking facilities that use AGVs, parking trays and VRCs can achieve operational efficiencies and some space efficiencies in view of the ability of AGVs to maneuver precisely in confined spaces.

The VRCs of a parking facility move through openings in the horizontal support structure that defines the ceiling of one level of a parking facility and the floor of the vertically adjacent level of the parking facility. Vehicle drivers, passengers and employees of the parking facility generally will not be present on the various parking levels of the facility. As a result, the openings through which the VRCs move do not have the complex and costly safety doors on each floor of the facility comparable to those used with a passenger elevator. Additionally, the openings through which the VRCs move generally are not surrounded by walls.

As noted above, the AGVs are precisely controllable and normally can be relied upon to move toward the opening that accommodates a VRC only when the platform of the VRC is present at the opening to accommodate the AGV thereon. However, software can malfunction in any industry. A software malfunction could result in an AGV with a vehicle thereon moving into the opening for a VRC even though the VRC platform is not present to receive the AGV and the passenger vehicle thereon. In this situation, the AGV and the passenger vehicle could fall several stories through the vertically aligned openings, thereby causing catastrophic damage to the vehicle and to the parking facility itself. Employees or customers also could be injured by the debris generated by an AGV and passenger vehicle falling several stories through the vertically aligned openings that are intended to accommodate the VRC.

As noted above, the automated nature of the above-described parking facility results in most parking levels being devoid of human beings most of the time. However, a parking lot could require human intervention at certain times, such as to complete repairs in the parking facility or in the event of an emergency, such as a fire or a power failure. An emergency worker who is unfamiliar with the layout of the parking facility could be required to move through the parking facility under conditions that offer limited visibility, due to darkness or smoke. An emergency worker, therefore, easily could fall into one of the openings that is intended to accommodate a VRC. A fall of several stories could be fatal. Doors that are comparable to the doors used for a passenger elevator would be prohibitively expensive and require costly maintenance. A low barrier could impede movement of an AGV, but would not protect an emergency worker during conditions of low visibility. A high gate could protect a worker, but creates storage problems when the gate is open. A gate that is strong enough to guide a worker away from the VRC opening may not be strong enough to stop an AGV. A gate that is strong enough to stop an AGV and that is high enough to protect a worker could be very heavy and difficult to move In view of the above, it is an object of the invention to provide a parking facility that prevents an AGV or a worker from falling into the opening of the parking facility that is intended to accommodate the VRC.

It is another object of the invention to provide a safety barrier that does not require excessive space in the parking facility.

A further object of the invention is to provide a safety barrier that is lightweight and inexpensive.

SUMMARY OF THE INVENTION

The invention relates to an automated parking system with a parking structure or location that has plural levels or floors. The parking structure has at least one bay for ingress and/or egress of vehicles. At least one vertically reciprocating conveyor (VRC) is provided for moving vehicles between the access point and a parking floor in the parking structure. The system further includes at least one automated guided vehicle (AGV) that can transport at least one vehicle within the parking structure. The system may also include a plurality of trays, each of which has a parking platform and a plurality of legs depending down from the parking platform so that the parking platform is supported in a sufficiently elevated position to enable the AGV to drive between the legs and under the parking platform of the tray. The AGV is configured to lift the tray with the vehicle thereon slightly from the floor of the parking facility so that the AGV and can transport the tray with the vehicle thereon.

Openings are provided in the levels of the parking facility above the ground level to accommodate the movement of the VRCs between the levels. Each level of the parking facility that has an opening to accommodate the movement of a VRC is provided with at least one safety barrier assembly in proximity to each of the respective openings. The safety barrier assembly is movable between a lower deployed safety position and an upper stored position. Each safety barrier assembly has a plurality of components that can move vertically relative to the floor of the parking facility and relative to one another.

The components of the safety barrier assembly comprise a horizontal AGV safety beam that is sufficiently high and sufficiently rigid to prevent an AGV from moving over or through the safety beam. The AGV safety beam preferably is formed from a rigid metallic material and may have a height of 4 inches-12 inches. Longitudinal end regions of the AGV safety beam may be formed with vertically aligned guide openings. Wheeled guide carriages are mounted to the opposite ends of the AGV safety beam to guide the vertical movement of the safety barrier assembly.

The safety barrier assembly further comprises upper and lower pedestrian safety barriers. Each pedestrian safety barrier assembly has a substantially inverted U-shape formed by a horizontal railing and two vertically legs extending down from opposite ends of the horizontal railing. The vertical legs of the upper pedestrian barrier are longer than the vertical legs of the lower pedestrian barrier. The vertical legs of the upper and lower pedestrian safety barriers are slidable within the vertically aligned openings at opposite ends of the AGV safety beam.

The safety barrier assembly further includes two vertical columns extending from the floor substantially to the ceiling at positions in front of the opening for the VRC and aligned substantially with opposite left and right sides of the opening for the VRC. The columns have vertical channels that can accommodated the wheeled carriages at opposite ends of the AGV safety beam. Additionally, a drive is provided for selectively raising and lowering the AGV safety beam and the pedestrian barriers along the columns. The drive may include a motor mounted in proximity to the top end of at least one column or on the ceiling of the parking level. The drive may further include cables or chains having one end connected to the safety beam and an opposite end engaged by the motor. Thus, the motor can operate to lift the AGV safety beam and the pedestrian barriers from a lower deployed position on or substantially adjacent to the floor of the parking facility to a raised stowed position spaced from the floor and in proximity to the ceiling or the top ends of the columns.

When the safety barrier assembly is in the lower deployed position, the AGV safety beam will be on or in proximity to the floor. Additionally, the bottom ends of the vertical legs of the pedestrian barriers will rest on the floor so that the horizontal railings of the pedestrian barriers will extend horizontally at positions above the AGV safety beam. The horizontal railing of the upper pedestrian barrier will be higher than the horizontal railing of the lower pedestrian barrier due to the different lengths of the legs of the pedestrian barriers. In a preferred embodiment, the horizontal portion of the upper pedestrian barrier may be at waist or chest height (e.g. 42 inches) when the safety barrier is in the lower deployed position.

The motor will cause the AGV safety beam to be moved into the upper stowed position when the VRC is filling the opening and in a position to accommodate an AGV thereon. This movement of the AGV safety beam and the pedestrian barriers will be generated by the upward movement of the AGV safety beam due to the pulling forces generated by the cables or chains that are connected operatively to the motor. Initial upward movement up the AGV safety beam will not affect the positions of the pedestrian barriers. However, the initial movement of the safety beam will cause sliding movement of the AGV safety beam along the vertical legs of the pedestrian barriers. After sufficient movement of the AGV safety beam, the upper surface of the AGV safety beam will contact the horizontal railing of the lower pedestrian barrier. At that point, any further upward movement of the AGV safety beam will cause the lower pedestrian barrier to lift concurrently with the AGV safety beam. The upper pedestrian barrier at this point will remain with the lower ends of the vertical legs supported on the floor. Further vertical movement of the AGV safety beam will cause additional sliding movement of the AGV safety beam along the vertical legs of the pedestrian barrier. Sufficient upward movement of the safety beam will cause the upper surface of the safety beam to contact the horizontal portion of the upper pedestrian barrier. Thus, any further upward movement of the AGV safety beam will cause simultaneous movement of the upper pedestrian barrier. Thus, both the upper and lower pedestrian barriers will move upward with the AGV safety beam. The vertical legs of the pedestrian barriers are near the opposite ends of the AGV safety beam and in proximity to the columns. As a result, the vertical legs of the pedestrian barriers will not impede access of an AGV and passenger vehicle onto a VRC platform waiting at the opening.

The safety barrier assembly may be configured so that the AGV safety beam and the pedestrian barriers are in the lower deployed position at all times except when the platform of a VRC is detected as being present at the floor. The safety barrier will be lifted only when the platform of the VRC has been detected at the floor.

DETAILED DESCRIPTION OF THE PREFERRED EMBODIMENT

Figure 1:
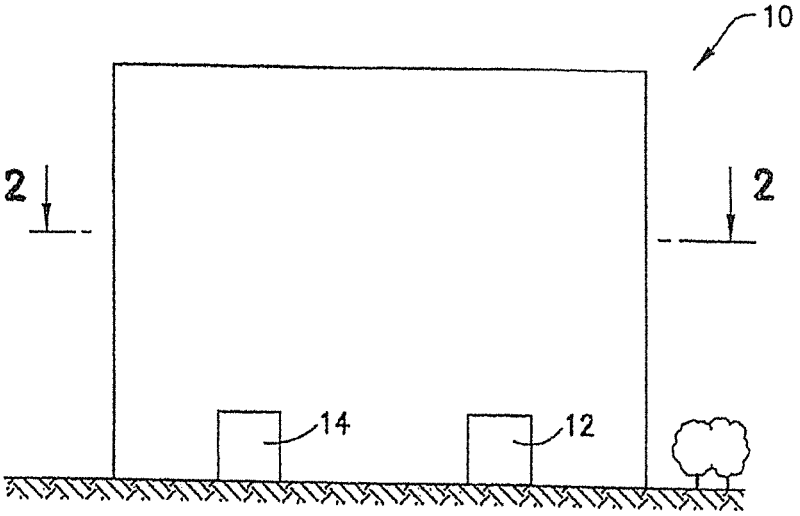
FIG. 1 is a front elevation view of a parking structure that includes the system of the subject invention.
Figure 2:
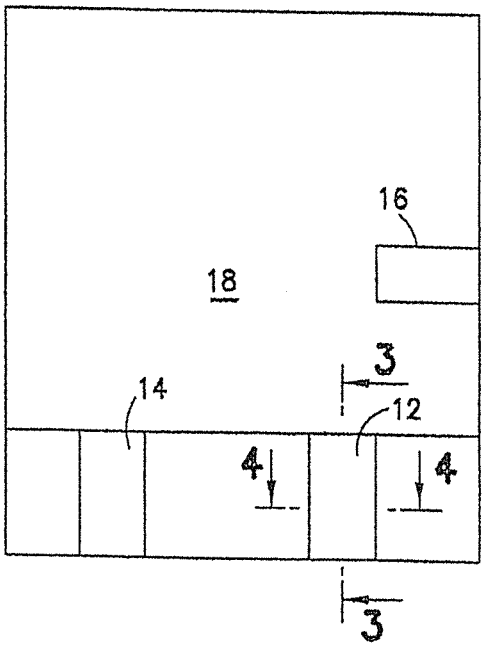
FIG. 2 is a cross-sectional view taken along line 2-2 of FIG. 1, and showing the ground floor where vehicles enter and exit a multi-floor parking facility.

A parking garage in accordance with the invention is identified generally by the numeral 10 in FIGS. 1-5. The parking garage 10 includes an ingress bay 12 and an egress bay 14, each of which is dimensioned to receive an automotive vehicle. At least one vertical reciprocating conveyor (VRC) 16 is disposed in proximity to the ingress and egress bays 12 and 14. Additionally, a queue area 18 is disposed between the ingress bay 12 and the VRC 16 to accommodate vehicles that are waiting for the VRC 16 to become available. Automated doors preferably are provided between the queue area 18 and in the ingress and egress bays 12 and 14 to prevent customers from accessing the queue area 18. The doors to the queue area 18 will be open only after the customer has left the ingress or egress bays 12 and 14. The parking garage 10 further includes a plurality of floors that can be accessed by the VRC 16. Each floor includes a plurality of areas where vehicles can be parked. Each floor has a plurality of magnet arrays 20 affixed to the floor at positions spaced apart, for example, by approximately 10 feet. Each magnet array 20 includes a plurality of magnets 22. The pattern of positive and negative poles of each magnet 22 within each magnet array 20 is specified to define unique addresses or signatures for the magnets 22 and the magnet arrays 20. Each magnet 22 preferably is a thin planar structure attached to a sheet 23 or laminated between two sheets 23. The sheet 23 of their respective magnet array 20 band is affixed to the floor by adhesive or mechanical attachment members at a specified location and in a specified orientation.

The parking system of the invention utilizes a plurality of trays 24, as shown in FIGS. 3, 4, 7 and 8. Each tray 24 includes a substantially rectangular parking platform 26 with a top surface 28 for supporting a vehicle thereon and a bottom surface 29. Legs 30 project down from the parking platform 26 for supporting the parking platform 26 in a spaced position from the floor. The legs 30 may flare outward or inward slightly so that a plurality of parking trays 24 can be nested vertically for storage and transportation.

Figure 3:
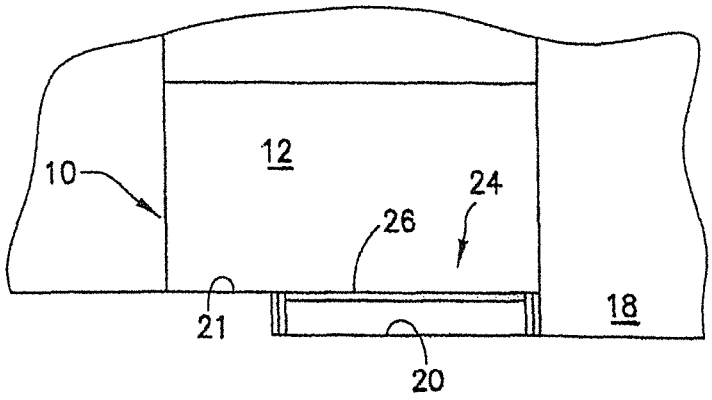
FIG. 3 is a cross-sectional view taken along line 3-3 of FIG. 2.
Figure 4:
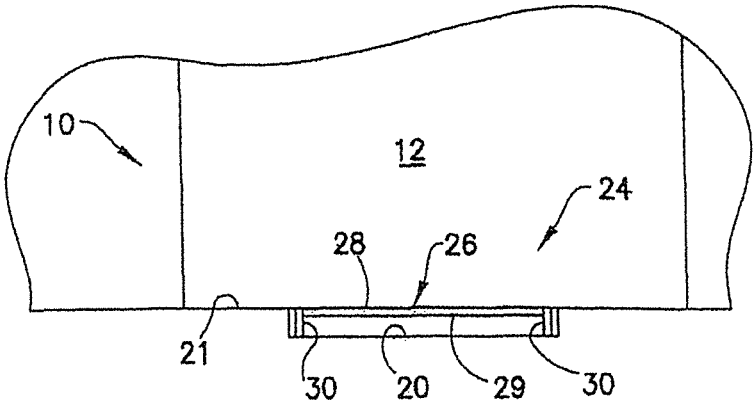
FIG. 4 is a cross-sectional view taken along line 4-4 of FIG. 2.
Figure 5:
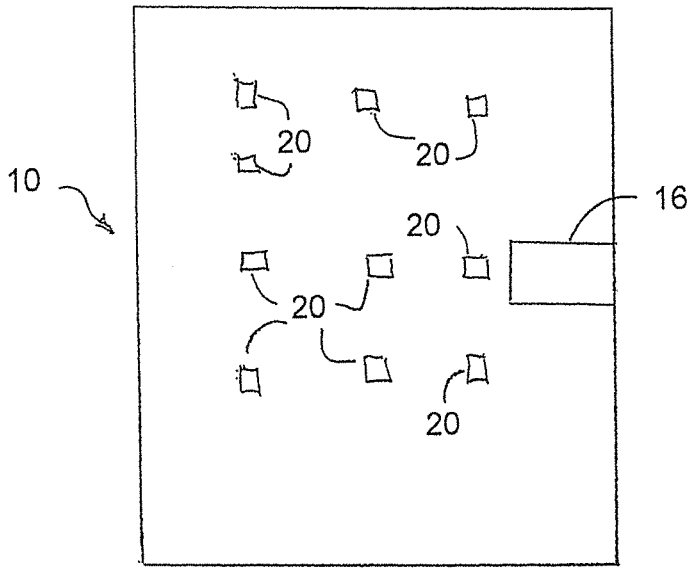
FIG. 5 is a top plan view of a portion of an upper level floor of the parking facility where vehicles are parked, and further showing the magnet arrays on the upper level floor of the parking facility.
Figure 6:
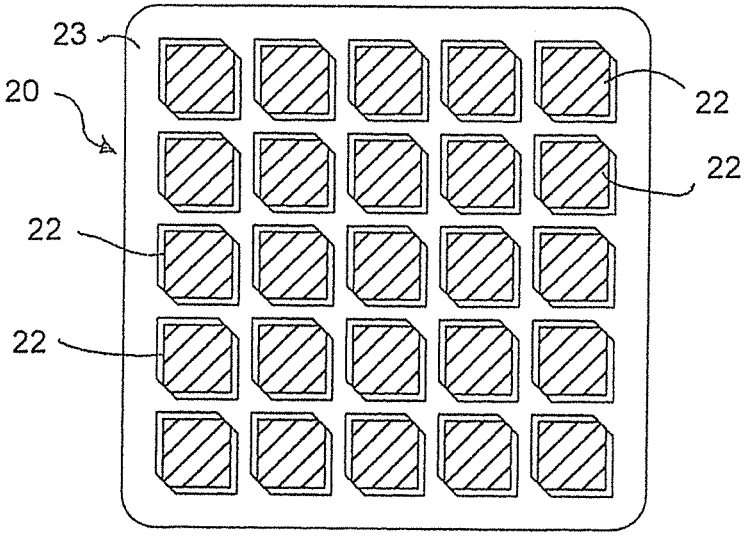
FIG. 6 is a top plan view of one embodiment of a magnet array in accordance with the invention.
Figure 7:
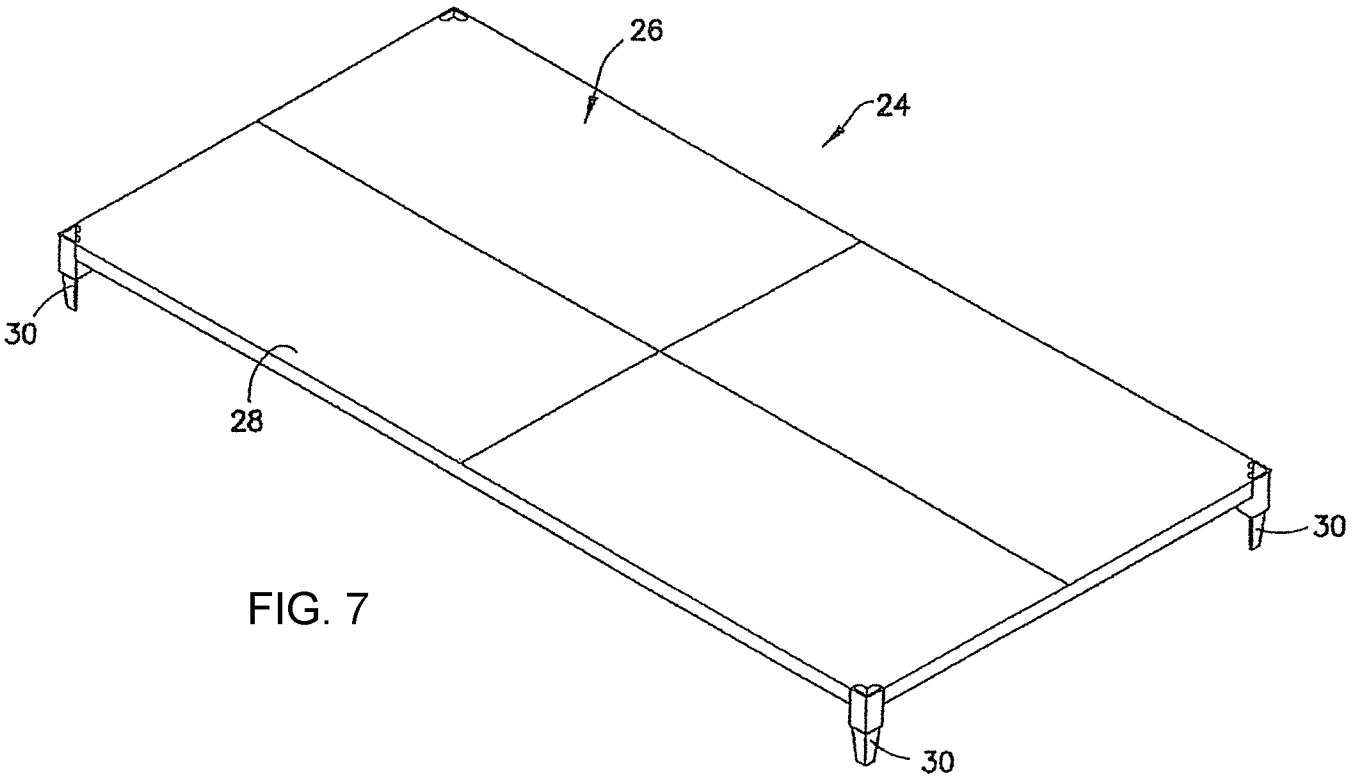
FIG. 7 is a perspective view of a tray in accordance with the invention.
Figure 8:
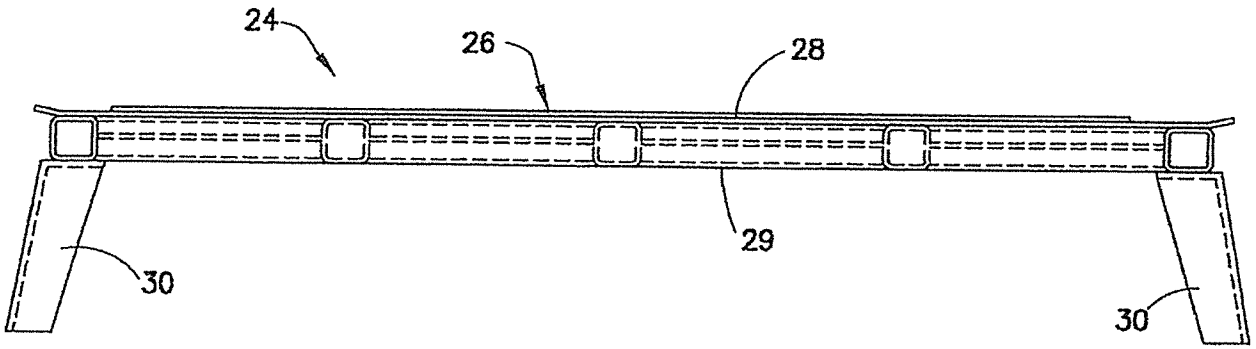
FIG. 8 is a side elevational view of the tray.
Figure 9:
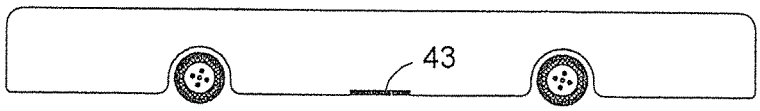
FIG. 9 is a side elevational view of an automated guided vehicle in accordance with the invention.
Figure 10:
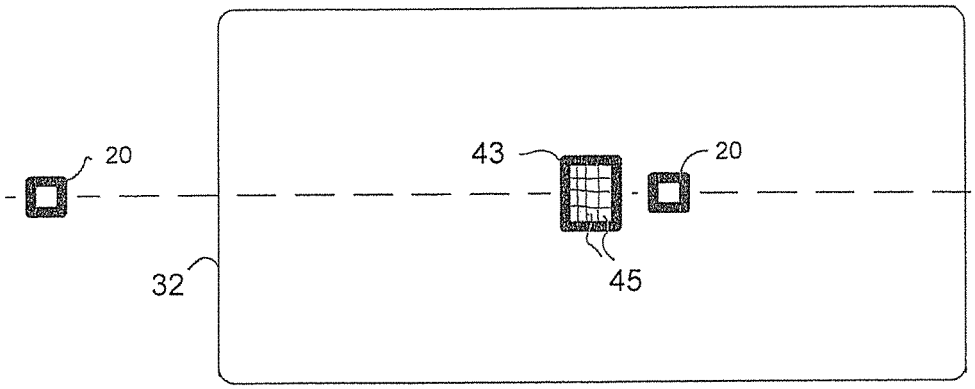
FIG. 10 is a top elevational plan view of the automated guided vehicle on a parking floor and in proximity to two of the magnet arrays.
Figure 11:
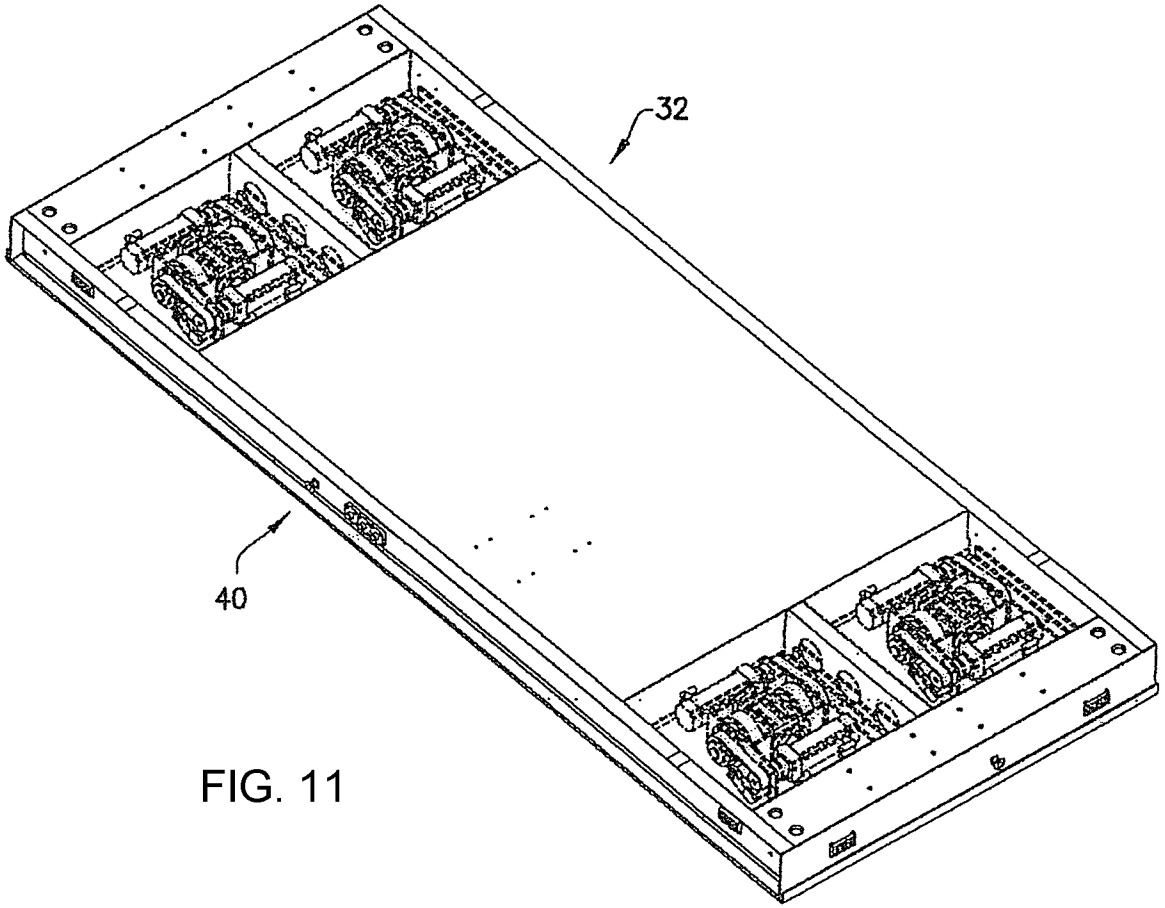
FIG. 11 is a bottom perspective view of the automated guided vehicle of FIG. 9.
Figure 12:
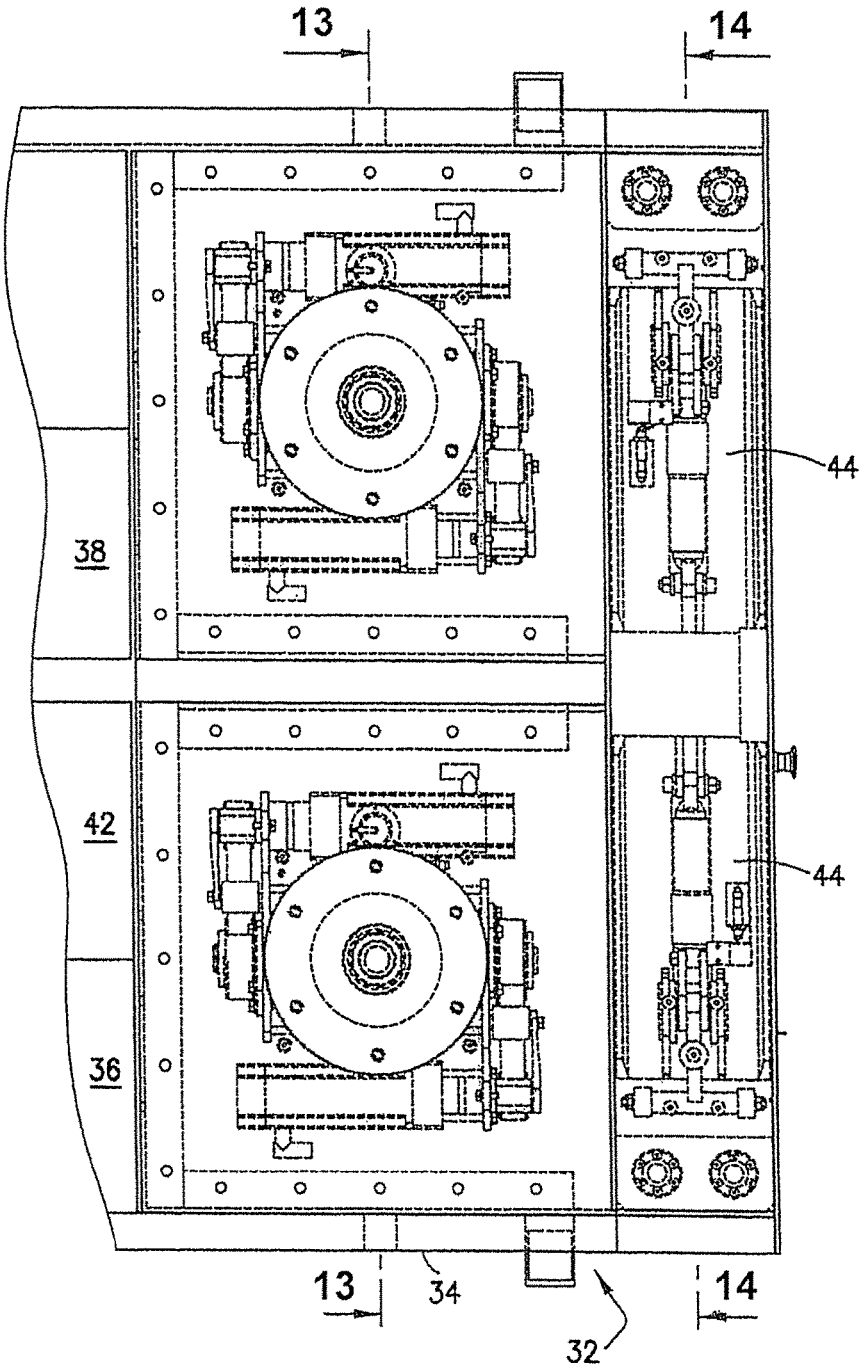
FIG. 12 is a bottom plan view of one end of the automated guided vehicle.
Figure 13:
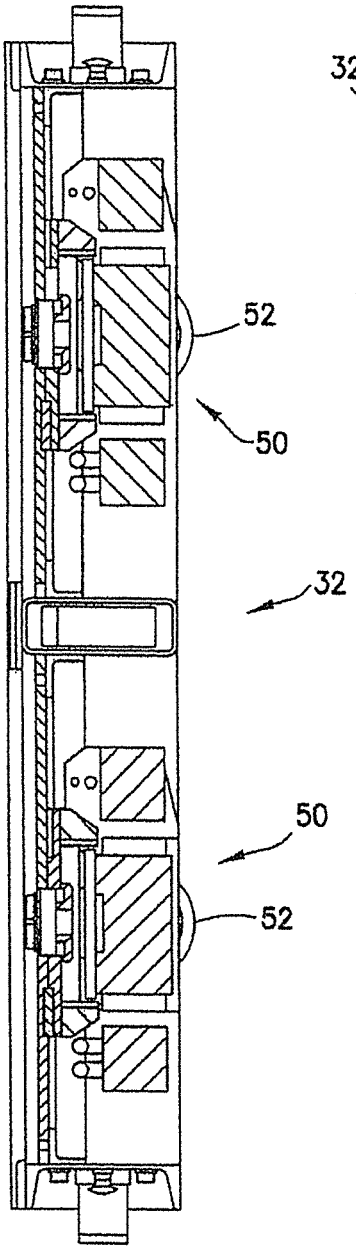
FIG. 13 is a cross-sectional view taken along line 13-13 in FIG. 12.
Figure 14:
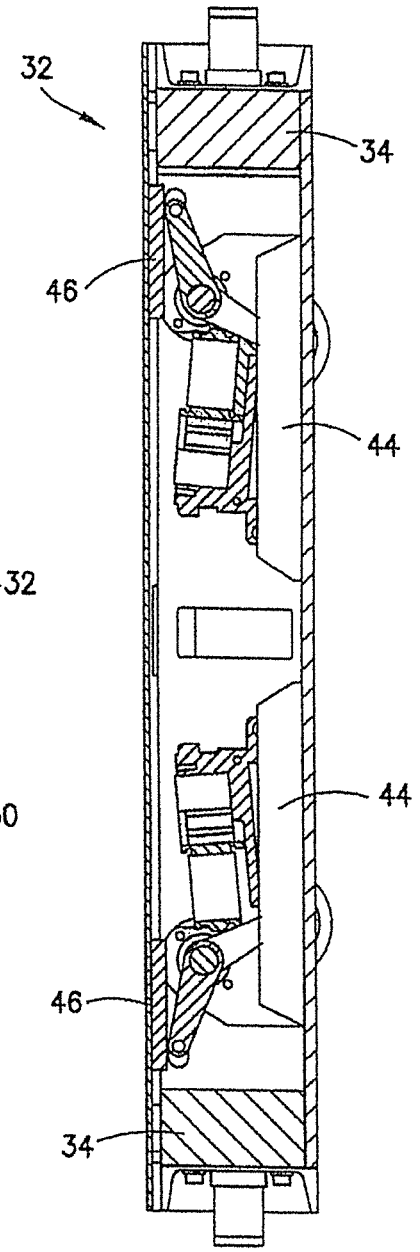
FIG. 14 is a cross-sectional view taken along line 14-14 in FIG. 12.
Figure 15:
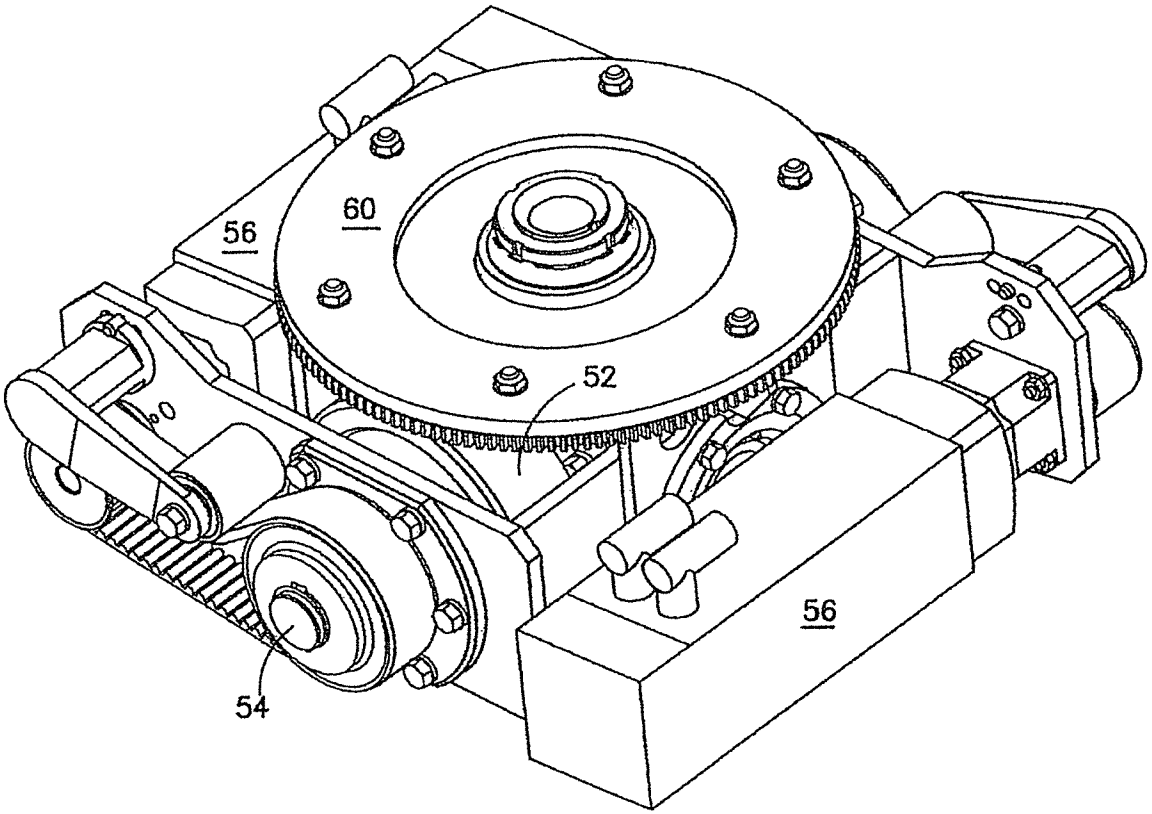
FIG. 15 is a perspective view of a drive device for the automated guided vehicle.
Figure 16:
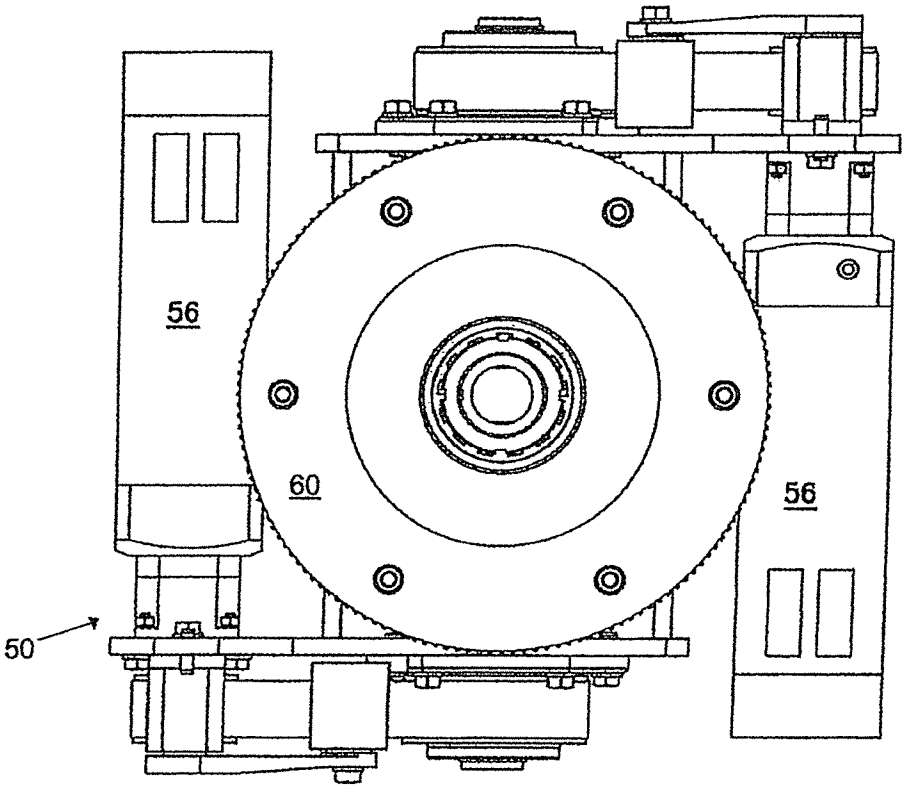
FIG. 16 is a top plan view of the drive device.
Figure 17:
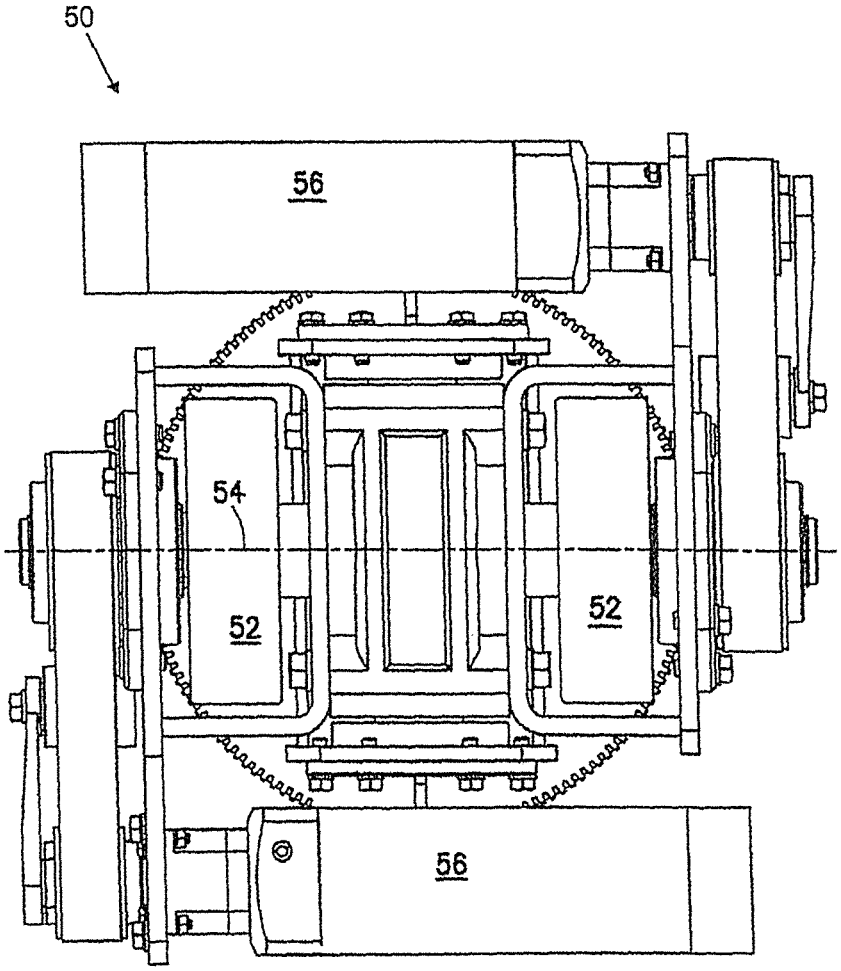
FIG. 17 is a bottom plan view of the drive device.
Figure 18:
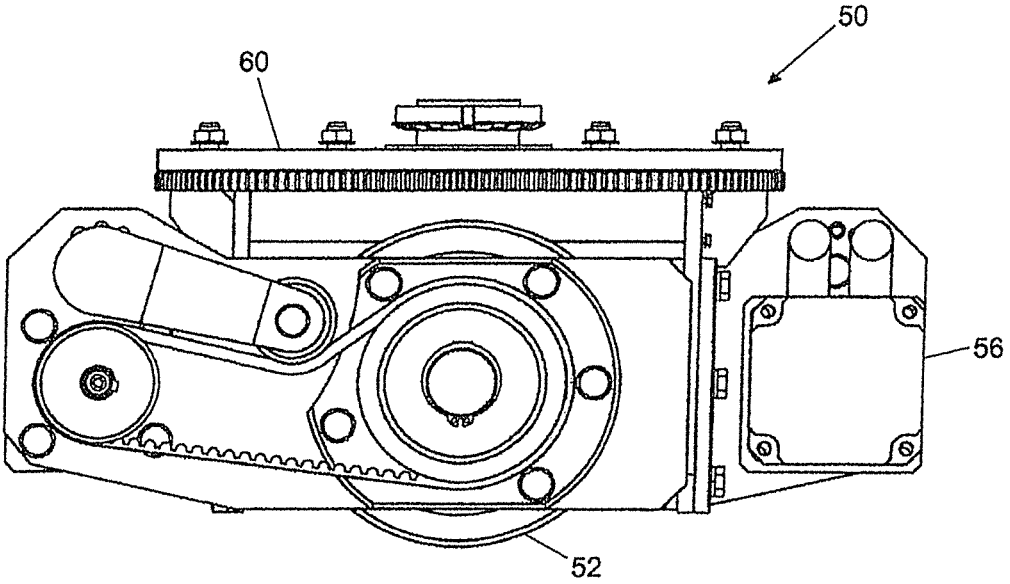
FIG. 18 is a side elevational view of the drive device.

The ingress and egress bays 12 and 14 each include a recessed floor 20 dimensioned to receive one of the trays 24 or a magazine of trays 25, as shown in FIGS. 3 and 4 and as explained further below. The recessed floor 20 is lower than the floor 21 at other locations in the ingress or egress bays 12 or 14 by a distance substantially corresponding to the height of the tray 24 or a height of the magazine. Thus, the top surface 28 of the parking platform 26 will be substantially flush with the floor 21 adjacent the recessed floor 20 when the tray 24 is positioned on the recessed floor 20 in the ingress or egress bay 12 or 14, as shown in FIGS. 3 and 4. As a result, a vehicle that enters the ingress bay 12 can drive across the floor 21 and onto the upper surface 28 of the parking platform 26 of the tray 24. Similarly a vehicle on a tray 24 in the egress bay 14 can drive from the upper surface 28 of the parking platform 26 of the tray 24 onto the floor 21 of the egress bay 14 and out of the parking garage 10. The floor in the queuing area 18 is substantially flush with the floor in the recess 20 as shown most clearly in FIG. 3. At least one movable platform 31 is provided in proximity to the recessed floor 20 in the ingress bays 12 and the egress bay 14 and can be moved between first and second positions. The upper surface of the movable platform 31 is flush with the floor 21 and flush with the upper surface 28 of the parking platform 26 of the tray 24 when the movable platform 31 is in the first position so that a passenger easily can exit or enter the vehicle in the ingress bay 12 or the egress bay 14 by walking across the movable platform 31. The upper surface of the movable platform 31 is displaced sufficiently in the second position so that the space under the tray 24 can be accessed for lifting and moving the tray 24, as explained further herein. The movement of the platform 31 between the first and second positions can be vertical, horizontal or a combination of vertical and horizontal movements.

The parking system of the invention also includes automated guided vehicles (AGV) 32 for transporting the trays 24 throughout the parking garage 10 with or without vehicles thereon, as shown in FIGS. 9-18. Each AGV 32 includes a substantially rectangular frame 34 that includes an interior 36 for accommodating the operative parts of the AGV 32. More particularly, the interior 36 of the frame 34 includes an array of rechargeable batteries 38 for providing power to operate the AGV 32. The batteries 38 communicate with one or more recharging connectors 40 in a peripheral region of the frame 34. Additionally, the interior of the frame 34 includes a controller 42 for controlling the various operative parts of the AGV 32 as explained herein. The controller 42 further includes a transmitter and a receiver for communicating with a central control for the parking garage 10. The interior of the frame 34 of the AGV 32 further includes a Hall effect sensor apparatus 43 that communicates with the controller 42. The Hall effect sensor apparatus 43 includes an array of Hall effect sensors 45 to sense the magnets 22 in each magnet array 20 as the Hall sensors 45 moves into a position opposed to the respective magnets 22 of the corresponding magnet array 20. The number of Hall effect sensors 45 in the Hall effect sensor array 43 can be selected in accordance with the desired sensitivity and the size and complexity of the parking garage 10. In one embodiment, the Hall effect sensor array 43 has 16 rows and 27 columns.

The AGV 32 further includes four platform lifts 44 disposed within the interior 36 of the frame 34. More particularly, two platform lifts 44 are disposed in proximity to each of the respective longitudinal ends of the AGV 32. The two platform lifts 44 at each end of the AGV 32 are connected to a tray support platform 46 that can be raised or lowered relative to the frame 34. At the lowered or retracted position, the tray support platforms 46 are substantially flush with the upper surface of the frame 34. In the raised or extended position, the tray support platforms 46 project slightly above the upper surface of the frame 34. The platform lifts 44 and the respective tray support platforms 46 are used to raise and lower the trays 24 with or without vehicles thereon as explained herein.

The AGV 32 further includes four drive devices 50 disposed at corners of a rectangle and disposed inwardly of the elevator mechanisms 44. Each drive device 50 includes two wheels 52 mounted for rotation about a horizontal axis 54. The two wheels 52 of each drive device 50 are driven respectively by two drive motors 56 so that each wheel 52 has a dedicated drive motor 56. The assembly of wheels 52 and drive motors 56 on each drive device 50 is mounted to a turntable 60 so that the assembly of wheels 52 and drive motors 56 on each of the drive devices 50 can be rotated about a vertical axis. The turntable 60 freely rotatable about a vertical axis and is driven rotatably by the wheels 52 and their respective drive motors 56. The drive motors 56 are operated independently pursuant to signals received from the controller 42 of the respective AGV 32, which in turn is driven by controls of the parking garage.

The longitudinal and lateral dimensions of each AGV 32 enable the AGV 32 to fit between the legs 30 of a tray 24. Additionally, the height dimensions of each AGV 32 enable the AGV 32 to fit beneath the parking platform 26 of the tray 24 when the tray is supported on the legs 30.

In use, a tray 24 will be positioned on the recessed floor 20 in the ingress bay 12 of the parking garage 10 at a position so that a vehicle can drive across the floor 21 of the ingress bay 12 and onto the parking surface 28 of the parking platform 26 of the tray 24. Electro-optical signage in the ingress bay 12 will guide the driver of the vehicle to a proper position on the tray 24. The driver then will exit the vehicle and issue appropriate instructions regarding parking duration and payment method. The instructions may be delivered verbally to an employee of the parking garage 10 or may be delivered electronically, as explained above. The movable platform 31 will move to the second position after the driver and any passengers exit the ingress bay 12. An AGV 32 then will move from the queue area 18 and into the space beneath the parking platform 26 of the tray 24 so that the tray 24 and the vehicle thereon can be raised and moved to the queue area 18 and/or the VRC 16. This process can be carried out in reverse at the egress bay 14. More particularly, an AGV 32 can deliver a tray 24 and the vehicle thereon onto the recessed floor 20 in the egress bay 14. The AGV 32 then will exit the egress bay 14 and return to the queue area 18. The movable platform 31 then will move from the second position to the first position where the upper surface of the movable platform 31 is flush with the floor 21 in the egress bay 14. The driver and any passengers then will be permitted to enter the egress bay 14 so that the vehicle can exit the parking garage 10.

The tray 24 with the vehicle thereon then will be transported to the VRC 16. This transportation between the ingress bay 12 and the VRC 16 can be carried out by any of several optional means. Preferably, an AGV 32 will move beneath the tray 24. The platform lifts 44 of the AGV 32 then will be moved into their extended positions so that the tray 24 with the vehicle thereon is elevated slightly from the floor 20 so that the AGV 32 can transport the tray 24 and the vehicle thereon to the VRC 16. Alternatively, a conveying mechanism can move the vehicle from the ingress bay 12 to the VRC 16.

The VRC 16 will move the tray 24 with the vehicle thereon to a selected floor in the garage 10 for parking. An AGV 32 then will transport the tray 24 and the vehicle to a preselected parking location. More particularly, the AGV 32 will move between the legs 30 of the tray 24 and into a position for properly supporting the tray 24. This accurate positioning can be determined by the Hall sensor 43 on the AGV 32 and the magnet arrays 20 on the floor. The proper positioning of the AGV 32 relative to the tray 24 will be transmitted to the controller 42 of the AGV 32, which will generate a signal to operate the platform lifts 44 of the AGV 32. The platform lifts 44 will cause the tray support platforms 46 to move into the extended position so that the tray 24 with the vehicle thereon is lifted sufficiently for the legs 30 of the tray 24 to be spaced from the floor. The controller 42 of the AGV 32 then will issue appropriate signals for operating the drive devices 50 of the AGV 32. More particularly, the control of the AGV 32 will cause the drive motors 56 to drive the wheels 52 so that the AGV 32 delivers the tray 24 and the vehicle thereon to an appropriate predesignated parking location. In this regard, the drive motors 56 all can be operated independently of one another pursuant to instructions received from the controller 42. In some instances, the motors 56 on a single drive device 50 will be operated in opposite directions for turning the turntable 60 to steer the AGV 32 in the required direction. The operation of the drive devices 50 will be carried out in coordination with the signals received by the Hall effect sensors 45 on the AGV 32 as the AGV moves over the respective magnet arrays 20. As noted above, the magnets 22 of each magnet array 20 has a unique combination of positive and negative poles so that the Hall effect sensors 45 can identify a particular magnet 22 as the AGV 32 moves the Hall effect sensors 43 over the magnet array 20. The Hall effect sensor array 43 will be able to identify the particular magnet array 20, and hence can determine the specific location of the AGV 32 on the floor of the parking garage 10. Additionally, the Hall effect sensor array 43 will identify the particular magnetic 22 in the magnet array 20 to determine both the position and the alignment of the AGV 32. The magnet array 20 and the Hall effect sensor array can be considered to have rows of magnetics 22 extending in a left to right direction relative to the primary travel direction of the AGV 32 and columns extending in the primary travel direction of the AGV 32. The Hall effect sensor array 43 also has rows and columns of Hall effect sensors 45 will be able to identify the left-right position of the AGV 32 depending upon the particular magnetic 22 in the first row of magnetics in the magnet array 20 that is sensed as the respective Hall effect sensors 45 of the Hall effect sensor array 43 move into a position above the magnetic array 20. If the next magnetic grid 22 sensed by the Hall effect sensor 43 is in the same column, the controller 42 will determine that the AGV 32 is traveling parallel to the columns. However, if the second magnetic 22 sensed by a particular one of the Hall effect sensors 43 is in a different column of the magnet array 20, then the controller 42 will determine that the AGV 32 is moving in a direction skewed with respect to the alignment of the columns of magnetic grids 22. Thus, an appropriate corrective instruction can be issued to the drive devices 50 of the AGV.

Figure 19:
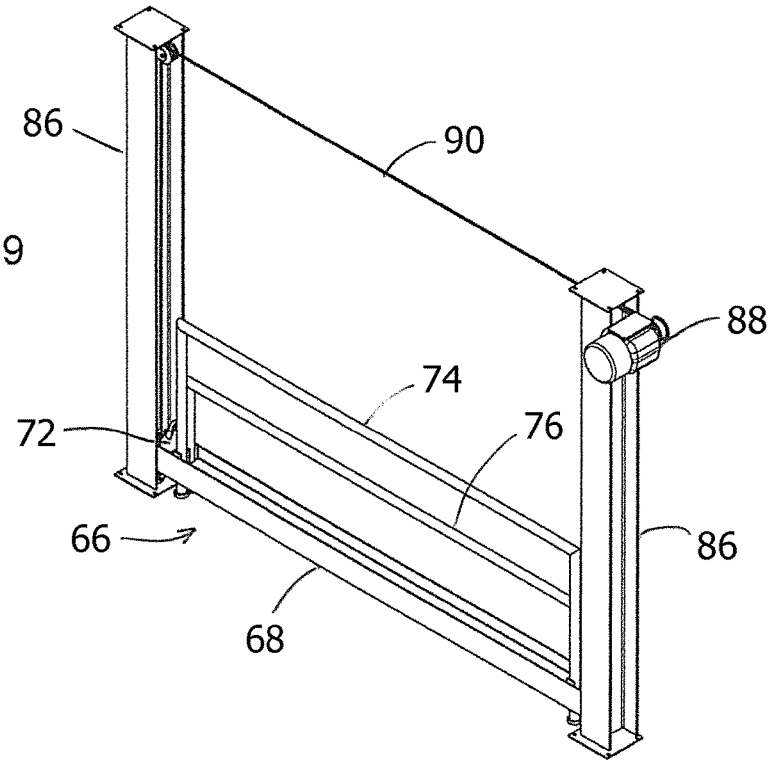
FIG. 19 is a perspective view of the safety barrier assembly in the lower deployed position.
Figure 20:
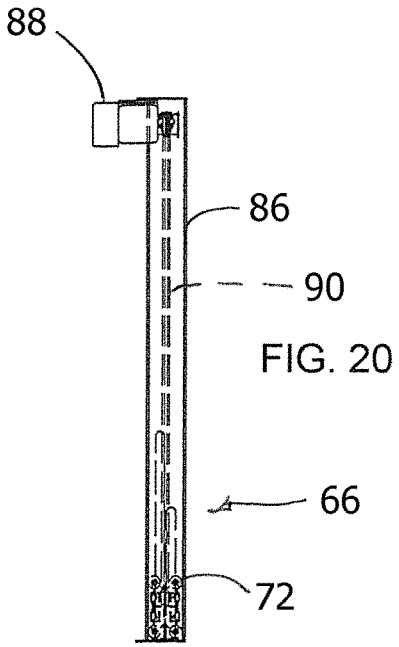
FIG. 20 is a side elevational view of the safety barrier assembly in the lower deployed position.
Figure 21:
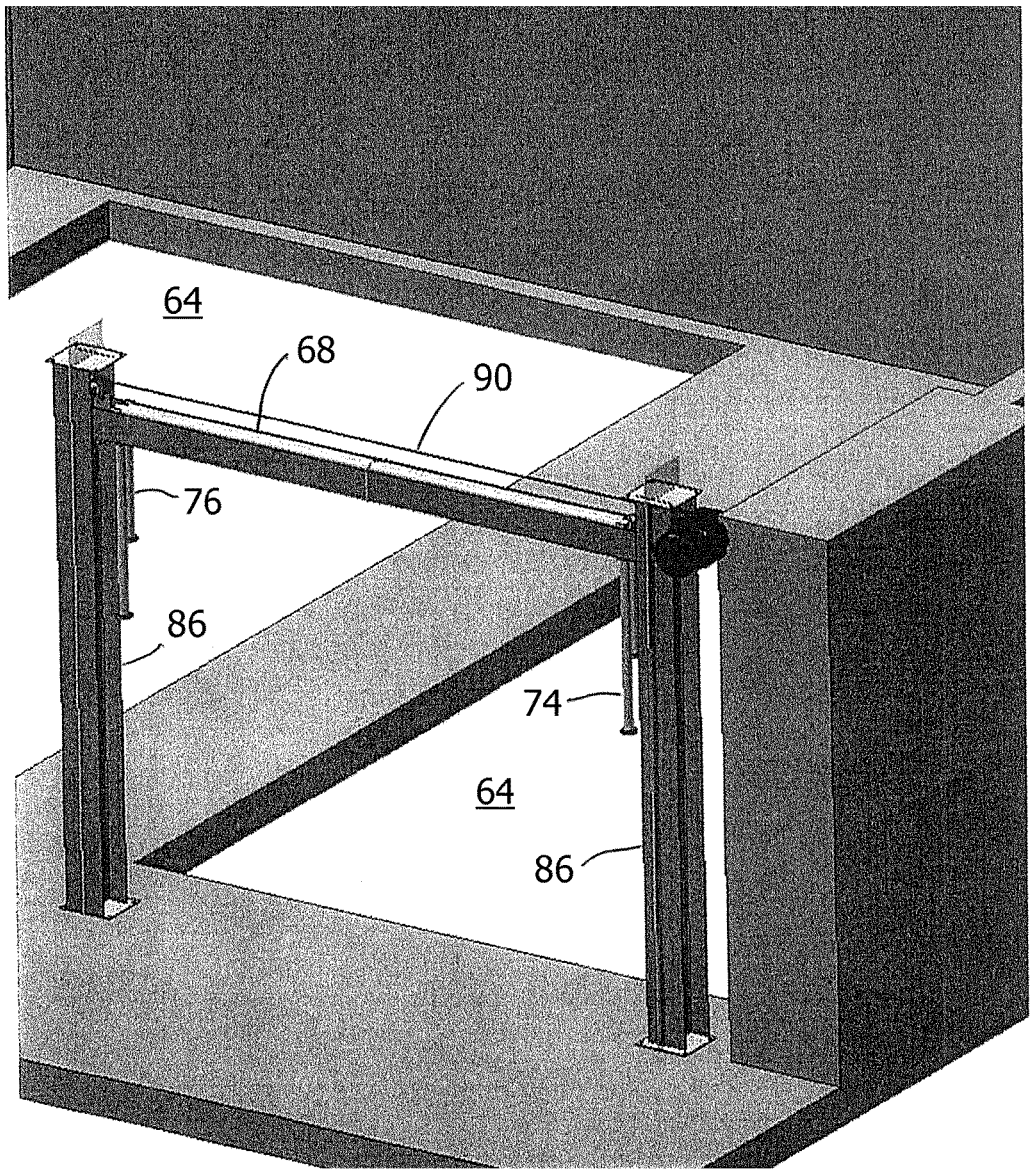
FIG. 21 is a perspective view of the safety area or assembly in the upper stored position and in proximity to an opening up a parking facility for accommodating a VRC.
Figure 22:
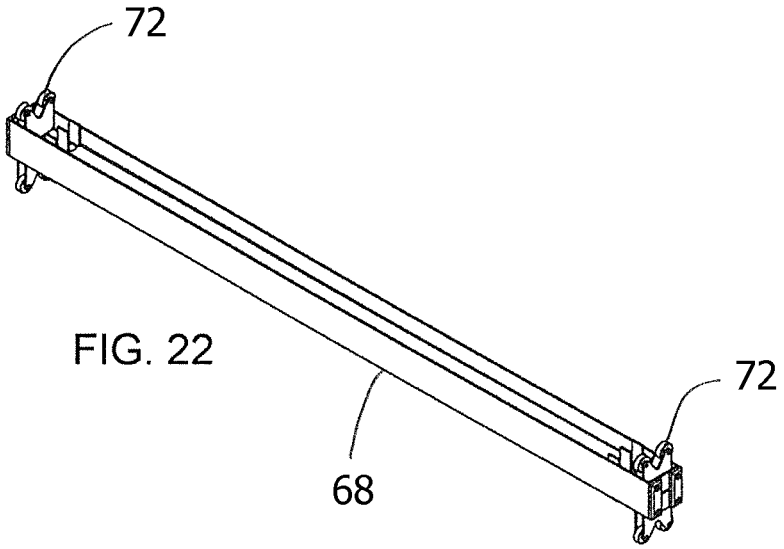
FIG. 22 is a perspective view of an AGV safety beam of the safety barrier assembly.
Figure 25:
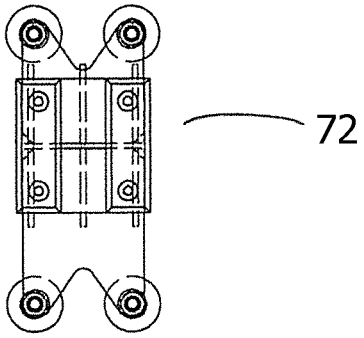
FIG. 25 is a front elevational view of the wheeled assembly of the AGV safety beam shown in FIGS. 23 and 24.
Figure 23:
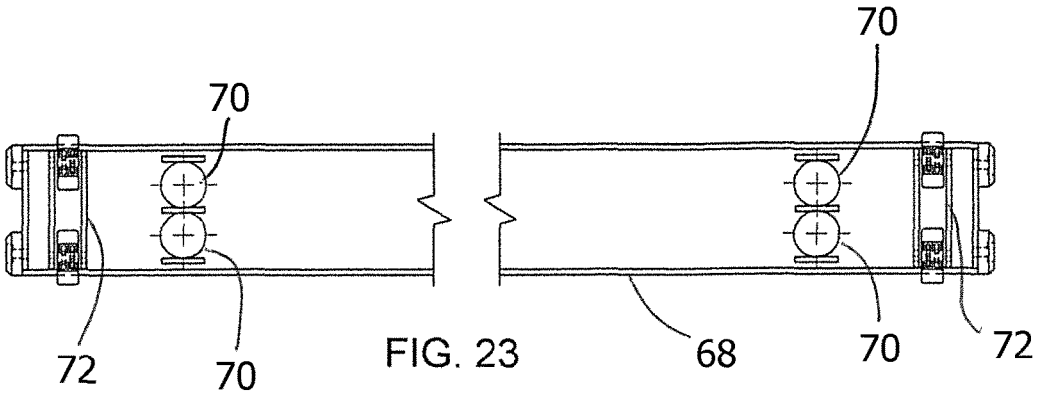
FIG. 23 is a top plan view of the AGV safety beam.
Figure 24:
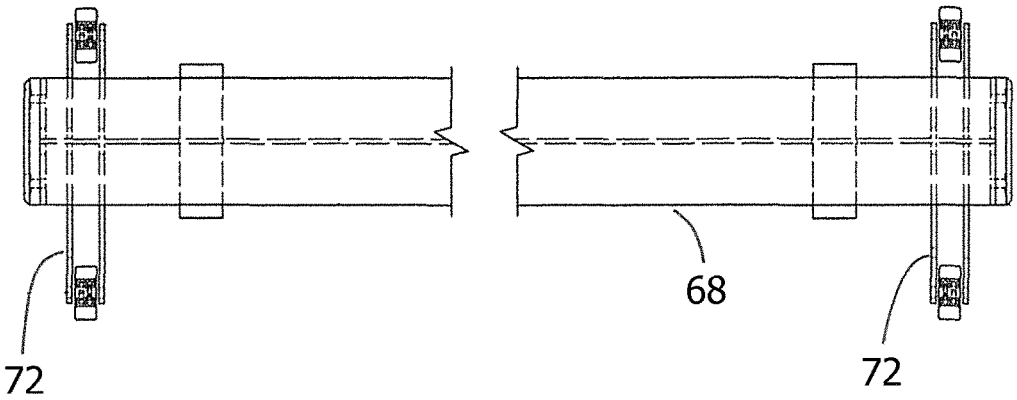
FIG. 24 is a front elevational view of the AGV safety beam.
Figure 26A:
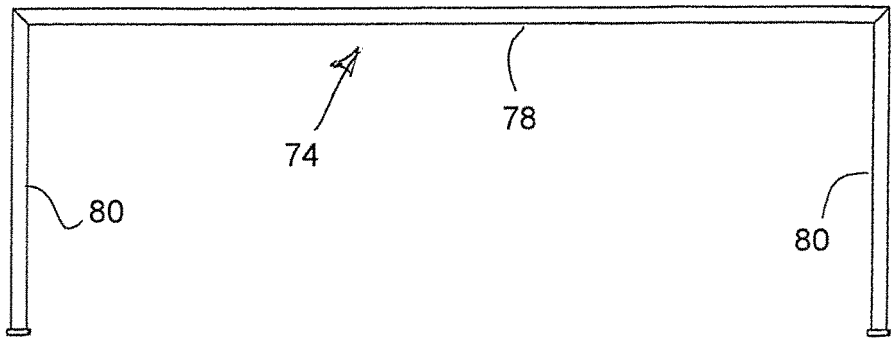
FIG. 26A is a front elevational view of the upper pedestrian barrier of the safety barrier assembly and FIG. 26B is a bottom plan view of the upper pedestrian barrier shown in FIG. 26A.
Figure 26B:
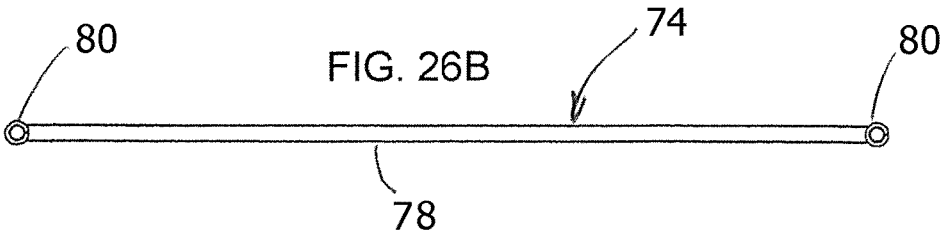
Figure 27A:
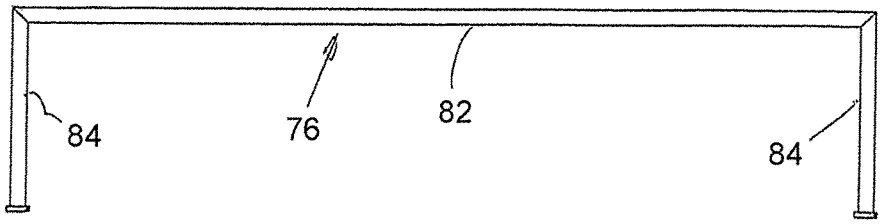
FIG. 27A is a front elevational view of the lower pedestrian barrier of the safety barrier assembly and FIG. 27B is a bottom plan view of the lower pedestrian barrier shown in FIG. 27A.
Figure 27B:
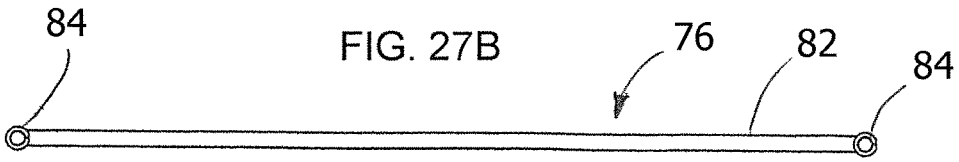

As shown in FIG. 21, openings 64 are provided in the levels of the parking garage 10 above the ground level to accommodate the movement of the VRCs 16 between the levels. Each level of the parking garage 10 that has an opening 64 to accommodate the movement of a VRC 16 is provided with at least one safety barrier assembly 66 in proximity to each of the respective openings 64. The safety barrier assembly 66 is movable between a lower deployed safety position, as shown in FIG. 19 and an upper stored position, as shown in FIG. 21. Each safety barrier assembly 66 has a plurality of components that can move vertically relative to the floor of the parking garage 10 and relative to one another.

The components of the safety barrier assembly 66 comprise a horizontal AGV safety beam 68, as shown in FIGS. 22-25. The AGV safety beam 68 is sufficiently high and sufficiently rigid to prevent an AGV 32 from moving over or through the AGV safety beam 68. The AGV safety beam 68 preferably is formed from a rigid metallic material and may have a height of 4 inches-12 inches. Longitudinal end regions of the AGV safety beam 68 may be formed with vertically aligned guide openings 70. Wheeled guide carriages 72 are mounted to the opposite ends of the AGV safety beam 68 to guide the vertical movement of the safety barrier assembly 66.

The safety barrier assembly 66 further comprises upper and lower pedestrian safety barriers 74 and 76. Each pedestrian safety barrier 74, 76 has a substantially inverted U-shape formed by a horizontal railing 78, 82 and two vertically legs 80, 84 extending down from opposite ends of the horizontal railing 78, 82. The vertical legs 80 of the upper pedestrian barrier 74 are longer than the vertical legs 84 of the lower pedestrian barrier 76. The vertical legs 80, 84 of the upper and lower pedestrian safety barriers 74, 76 are slidable within the vertically aligned openings 70 at opposite ends of the AGV safety beam 68.

The safety barrier assembly 66 further includes two vertical columns 86 extending from the floor substantially to the ceiling at positions in front of the opening 64 for the VRC 16 and aligned substantially with opposite left and right sides of the opening 64 for the VRC 16. The columns have vertical channels that can accommodate the wheeled carriages 72 at opposite ends of the AGV safety beam 68. Additionally, a drive 88 is provided for selectively raising and lowering the AGV safety beam 68 and the pedestrian barriers 74, 76 along the columns 86. The drive 88 may include a motor 88 mounted in proximity to the top end of at least one column 86 or on the ceiling of the parking level. The drive may further include cables or chains 90 and having one end connected to the AGV safety beam 68 and an opposite end engaged by the motor 88. Thus, the motor 88 can operate to lift the AGV safety beam 68 and the pedestrian barriers 74, 76 from a lower deployed position of FIG. 19 on or substantially adjacent to the floor of the parking garage 10 to a raised stowed position spaced from the floor and in proximity to the ceiling or the top ends of the columns 86, as shown in FIG. 21.

When the safety barrier assembly 66 is in the lower deployed position of FIG. 21, the AGV safety beam 68 will be on or in proximity to the floor. Additionally, the bottom ends of the vertical legs 80, 84 of the pedestrian barriers 74, 76 will rest on the floor so that the horizontal railings 78, 82 of the pedestrian barriers 74, 76 will extend horizontally at positions above the AGV safety beam 68. The horizontal railing 78 of the upper pedestrian barrier 74 will be higher than the horizontal railing 82 of the lower pedestrian barrier 76 due to the different lengths of the legs 80, 84 of the pedestrian barriers 74, 76. In a preferred embodiment, the horizontal railing 78 of the upper pedestrian barrier 74 may be at waist or chest height (e.g. 42 inches) when the safety barrier assembly 66 is in the lower deployed position of FIG. 19.

The motor 88 will cause the AGV safety beam 68 to be moved into the upper stowed position of FIG. 21 when the VRC 16 is filling the opening 64 and in a position to accommodate an AGV 32 thereon. This movement of the AGV safety beam 68 and the pedestrian barriers 74, 76 will be generated by the upward movement of the AGV safety beam 68 due to the pulling forces generated by the cables or chains 90 that are connected operatively to the motor 88. Initial upward movement up the AGV safety beam 68 will not affect the positions of the pedestrian barriers 74, 76. However, the initial movement of the AGV safety beam 68 will cause sliding movement of the AGV safety beam 68 along the vertical legs 80, 84 of the pedestrian barriers 74, 76. After sufficient movement of the AGV safety beam 68, the upper surface of the AGV safety beam 68 will contact the horizontal railing 82 of the lower pedestrian barrier 76. At that point, any further upward movement of the AGV safety beam 68 will cause the lower pedestrian barrier 76 to be lifted concurrently with the AGV safety beam 68. The upper pedestrian barrier 74 at this point will remain with the lower ends of the vertical legs 80 supported on the floor. Further vertical movement of the AGV safety beam 68 will cause additional sliding movement of the AGV safety beam 68 along the vertical legs 80 of the upper pedestrian barrier 74. Sufficient upward movement of the AGV safety beam 68 will cause the upper surface of the AGV safety beam 68 to contact the horizontal railing 78 of the upper pedestrian barrier 74. Thus, any further upward movement of the AGV safety beam 68 will cause simultaneous upward movement of the upper pedestrian barrier 74. Thus, both the upper and lower pedestrian barriers 74, 76 will move upward with the AGV safety beam 68. The vertical legs, 80, 84 of the pedestrian barriers 74 and 76 are near the opposite ends of the AGV safety beam 68 and in proximity to the columns 88. As a result, the vertical legs 80, 84 of the pedestrian barriers 74, 76 will not impede access of an AGV 32 and passenger vehicle onto a VRC 16 platform waiting at the opening 64. Furthermore, the total height required for the safety barrier assembly 66 above a parked vehicle when the safety barrier assembly 66 is in the upper position is approximately equal to the vertical height of the AGV safety beam 68. As a result, the safety barrier assembly 66 does not add significantly to the total required height for the parking level of the parking garage 10.

The safety barrier assembly 66 may be configured so that the AGV safety beam 68 and the pedestrian barriers 74, 76 are in the lower deployed position of FIG. 19 at all times except when the platform of a VRC 16 is detected as being present at the floor. The safety barrier assembly 66 will be lifted to the position of FIG. 21 only when the platform of the VRC 16 has been detected at the floor.

The invention has been described with respect to certain preferred embodiments. However, other changes within the scope of the invention will be apparent to those skilled in the art after having read this description of the preferred embodiments and the accompanying drawings.

What is claimed is:

1. A safety barrier assembly for a parking garage having a vertical reciprocating conveyor (VRC) and openings in floors of the parking garage for accommodating vertical movement of the VRC, the safety barrier assembly being positioned in proximity to each of the openings and comprising:

a substantially horizontally aligned automated guided vehicle (AGV) safety beam having opposite left and right longitudinal ends, openings formed vertically through the AGV safety beam in proximity to the longitudinal ends;

upper and lower pedestrian barriers having horizontal railings and vertical legs extending from opposite ends of the horizontal railings, the vertical legs of the upper and lower pedestrian barriers being slidable within the openings formed through the AGV safety beam, the vertical legs of the upper pedestrian barrier being longer than the vertical legs of the lower pedestrian barrier;

left and right columns engaged with the opposite left and right longitudinal ends of the AGV safety beam and guiding vertical movement of the AGV safety beam from a lower position where the AGV safety beam is substantially adjacent to a floor of the parking garage and an upper position where the AGV safety beam is elevated from the floor; and a motor for selectively moving the AGV safety beam between the lower position and the upper position.

2. The safety barrier assembly of claim 1, wherein the vertical legs of the upper pedestrian barrier are approximately 42 inches long.

3. The safety barrier assembly of claim 1, further comprising left and right wheeled carriages mounted respectively to the opposite left and right longitudinal ends of the AGV safety beam.

4. The safety barrier assembly of claim 1, wherein the AGV safety beam has a vertical height of approximately 4-12 inches.

5. The safety barrier assembly of claim 1, further comprising sensors and a control for controlling the AGV safety beam.

* * * * *